United States Patent [19]

Arnold et al.

[11] 4,225,446

[45] Sep. 30, 1980

[54] PROCESS FOR PREPARING HIGHLY BASIC MAGNESIUM SULFONATES

[75] Inventors: Jerry D. Arnold, Vidalia, La.; Harry J. Fair, Winetka, Ill.; Laura V. Fair; Johnny D. Berry, both of Natchez, Miss.

[73] Assignee: Calumet Industries, Inc., Chicago, Ill.

[21] Appl. No.: 892,495

[22] Filed: Apr. 3, 1978

[51] Int. Cl.[2] ..... C10L 1/24; C10L 1/18; C10M 1/38; C10M 1/24

[52] U.S. Cl. ..... 252/33.2; 44/51; 252/33

[58] Field of Search ..... 252/33, 33.2; 44/51

[56] References Cited

U.S. PATENT DOCUMENTS

| | | | |
|---|---|---|---|
| 2,959,545 | 11/1960 | Alford | 252/33.2 |
| 3,488,722 | 1/1970 | Allphin | 252/33.2 |
| 3,492,230 | 1/1970 | Watson et al. | 252/33 |
| 3,524,814 | 8/1970 | Sabol et al. | 252/33.2 |
| 3,609,076 | 9/1971 | Sabol et al. | 252/33.2 |
| 3,629,109 | 12/1971 | Gergel et al. | 252/33 |
| 3,853,774 | 12/1974 | Crocker | 252/33 |
| 3,865,737 | 2/1975 | Kemp | 252/33 |
| 4,148,740 | 4/1979 | Cease et al. | 252/33 |

*Primary Examiner*—Delbert E. Gantz
*Assistant Examiner*—Irving Vaughn
*Attorney, Agent, or Firm*—Hume, Clement, Brinks, Willian & Olds, Ltd.

[57] ABSTRACT

A process for preparing highly basic magnesium sulfonates useful as lubricants including (a) forming an admixture of an oil-soluble sulfonic acid, a previously overbased magnesium sulfonate having a TBN in excess of about 200, a lower alkanol, and a volatile solvent, (b) heating the admixture to neutralize the acid, (c) cooling the first admixture and then forming a second admixture by adding magnesium oxide, naphthenic acid, a lower alkanol and a diluent oil, (d) carbonating the second admixture with carbon dioxide, while simultaneously adding water and ammonia or an ammonium compound as promoters, during the addition of about the first 25% of the carbon dioxide, (e) heating the carbonated solution to remove water and the lower alkanol, (f) further carbonating the solution for a short time between 180° F. and 220° F., (g) heating the solution to remove water, (h) diluting the solution with volatile solvent, (i) clarifying the solution, and (j) removing the volatile solvent, preferably by heating under vacuum.

43 Claims, No Drawings

PROCESS FOR PREPARING HIGHLY BASIC MAGNESIUM SULFONATES

BACKGROUND OF THE INVENTION

This invention relates to an improved process for the preparation of fluid, highly basic magnesium sulfonates useful as lubricants for internal combustion engines and as diesel fuel additives.

Highly basic magnesium sulfonates are known to be particularly effective additives for internal combustion engine lubricating oils and for diesel fuels. In this context, the term "highly basic" refers to sulfonates containing an amount of magnesium substantially in excess of that required to form a neutral sulfonate. Other terms which have been used to describe such sulfonates include overbased, superbasic and hyperbasic.

Many, many processes are known for preparing fluid, highly basic magnesium sulfonates. See, e.g., U.S. Pat. Nos. 3,492,230; 3,524,814; 3,609,076; 3,629,109; 3,865,737; and the numerous patents cited therein. While many of these prior art processes and patents claim to be suitable for commercial scale production of highly basic magnesium sulfonates, few highly basic magnesium sulfonates are available on the market.

Accordingly, there is still a need for improved, commercially viable processes for the preparation of commercial scale batches of fluid, highly basic magnesium sulfonates, especially processes which have a high utilization of magnesium and which produce sulfonates that have a high total base number (TBN), of about 385 or more, a low viscosity, an absence of haze and sediment, and good stability under engine use conditions.

SUMMARY OF THE INVENTION

This invention broadly relates to a process for treating a neutralized, fluid, oil-soluble, magnesium sulfonate with magnesium oxide and a unique combination and sequence of promoters and processing conditions to produce a fluid, highly basic magnesium sulfonate. The highly basic magnesium sulfonate produced by this process possesses an excellent combination of properties, including a high base number, a low viscosity, an absence of sediment and haze, and excellent engine stability; and it can be made economically, on a commercial scale.

In a preferred aspect of this invention, oil-soluble sulfonic acids are neutralized with a previously prepared overbased magnesium sulfonate, by admixing the sulfonic acid and the magnesium sulfonate and heating to neutralize. The neutralized magnesium sulfonates prepared in this manner may then be treated with magnesium oxide and the unique combination and sequence of promoters and processing conditions of the invention to produce a commercial quality, fluid, highly basic magnesium sulfonate.

In yet another preferred aspect of this invention, certain specific types of magnesium oxide are employed which aid in the production of high quality, fluid, highly basic magnesium sulfonates.

In a highly advantageous embodiment of the invention, an oil-soluble sulfonic acid is mixed with a previously prepared overbased magnesium sulfonate having a total base number (TBN) in excess of about 200, in the presence of a suitable volatile solvent. Preferably, a minor amount of a lower alkanol, such as methanol, is added to the mixture. This mixture is then heated to a temperature between about 180° F. and 260° F. or more, preferably between 200° F. and 220° F., to neutralize the sulfonic acid. After the neutralization has been completed, the solution is cooled, and a naphthenic acid, a lower alkanol, such as methanol, and magnesium oxide are added to the neutralized solution to form a second admixture. The magnesium oxide employed in this embodiment preferably has the following specific characteristics: a bulk density between about 13 and 20 lbs/ft$^3$, an Iodine No. between about 35 and 60 meq/100 g, and a particle size of about 200 mesh or smaller. Preferably, a non-volatile diluent oil is added at this point in the process.

This second admixture is then carbonated, preferably with gaseous or liquid carbon dioxide, at a temperature below about 120° F., preferably between 100° F. and 120° F. Water and ammonia or an ammonium compound are added as promoters during the initial phase of carbonation. Substantially all of the water and the ammonia or ammonium compound must be added after carbonation has begun and before the addition of the first 25% of the carbon dioxide has been completed. Preferably, these carbonation promoters are added slowly during the addition of the first 15% to 20% of the carbon dioxide. After carbonation has been completed, the solution is heated to a temperature in excess of the boiling point of the water and the lower aklanol, advantageously to 250° F. or more, to remove those substances and to eliminate or minimize the haze in the final product.

After heating, the solution is cooled somewhat, to a temperature between about 180° F. and 220° F., at which temperature additional carbon dioxide is added for a short time, for from about 10 to 30 minutes. Next, the solution is heated to an elevated temperature, advantageously about 250° F. or more, and then it is cooled to a temperature below about 220° F. Preferably, additional volatile solvent is then added. Next, the solution is clarified, preferably by centrifugation and/or filtration, to remove suspended solids and sediment, after which the volatile solvents advantageously are removed, by heating the solution, preferably under a vacuum.

A fluid, highly basic magnesium sulfonate made in accordance with this invention has a high TBN of 385 (mg KOH/g) or more, preferably 400–500, a relatively low viscosity, an absence of haze and sediment, and good stability under engine use conditions and in compatability tests. Such magnesium sulfonates also normally consist of from 25 to 35% magnesium sulfonate and from about 9 to 10.5% magnesium.

The principal advantage of the process of the invention is its ability to economically produce a commercially acceptable, fluid, highly basic magnesium sulfonate on a commercial scale. Other advantages of the invention include its high level of magnesium utilization and the consistently high base number and satisfactory engine and compatability test and use performance levels attainable with the highly basic magnesium sulfonate product. Further advantages include the product's consistent clarity, bright appearance, low viscosity, stability, and the extent of sulfonation.

Additional features and advantages of the invention are described in and will become apparent from the Description of the Preferred Embodiments and the Examples which are set forth below.

DESCRIPTION OF THE PREFERRED EMBODIMENTS

The initial steps in the preferred embodiments of the process of this invention comprise the neutralization of an oil-soluble sulfonic acid or a mixture of such acids with a previously prepared magnesium sulfonate having a TBN in excess of about 200, in the presence of a suitable volatile solvent and a minor amount of a lower alkanol.

Suitable oil-soluble sulfonic acids ($RSO_3H$) are well known in the art. They include both the mahogany or natural sulfonic acids and the synthetic sulfonic acids prepared from hydrocarbon feedstocks. The molecular weight of these oil-soluble sulfonic acids is preferably in the range of about 450 to 650, most preferably in the range of about 500 to 575. The hydrocarbon (R) portion of the oil-soluble sulfonic acids may be either an alkyl or an alkaryl hydrocarbon, with the alkyl groups being either straight or branch chains. The molecular weight of the hydrocarbon portion of the sulfonic acids employed in this process is advantageously in the range of about 385 to about 600.

The synthetic sulfonic acids are preferred for use in this process. These sulfonic acids may be prepared from alkyl or alkaryl hydrocarbons, or mixtures thereof, by any of the methods well known in the art. A particularly preferred synthetic sulfonic acid comprises a mixture of straight and branched chain sulfonated alkylates, with the branched chain alkylates having a molecular weight in the range of about 385 to about 450, preferably about 400 to about 450, and the straight chain alkylates having a molecular weight in the range of about 500 to about 600, preferably between about 500 and 575. These straight and branched chain alkylates may be sulfonated together, or they may be sulfonated separately and later combined.

The magnesium sulfonate used to neutralize the oil-soluble sulfonic acid may be any previously overbased magnesium sulfonate having a TBN in excess of about 200, advantageously between about 250 and 350, preferably between about 275 and 330. The other characteristics of this previously overbased magnesium sulfonate are not particularly critical since the primary reason for its use is to neutralize the oil-soluble sulfonic acid. Accordingly, the magnesium sulfonate may be made by any of the overbasing processes well known in the art, using the oil-soluble sulfonic acids well known in the art, as long as the TBN exceeds about 200. For example, the magnesium sulfonate may be made by the processes described in U.S. Pat. Nos. 3,609,076; 3,524,814; 3,629,109; and the like. The amount of magnesium sulfonate employed in the process should be sufficient to neutralize the oil-soluble sulfonic acid. Advantageously, sufficient magnesium sulfonate is employed to obtain a base number of between about 5 and 40, preferably between 5 and 10, for the neutralized product.

Suitable volatile solvents include hydrocarbon solvents having at least a part of their boiling point range between about 250° F. and 300° F. Preferably, the volatile solvent is either (a) an aliphatic hydrocarbon solvent having a boiling point range between about 250° F. and 300° F., preferably between about 260° F. and 285° F., or (b) a mixture of aliphatic and aromatic hydrocarbons, with the aliphatic hydrocarbon component having a boiling point range between about 140° F. and 190° F., and the aromatic hydrocarbon having a boiling point range between about 250° F. and 300° F., preferably between aout 265° F. and 285° F. Preferably, the volatile solvent comprises approximately 60 to 65 percent by weight of the total sulfonate neutralization mixture, although those skilled in the art will recognize that higher or lower concentrations of solvent may be employed. Advantageously, most, if not all, of the volatile solvent employed at this point in the process is the solvent used for the preparation of the oil-soluble sulfonic acid.

Suitable lower alkanols include methanol, ethanol, isopropanol, butanol, pentanol, hexanol, methoxy ethanol, ethoxy ethanol, butoxy ethanol, and the like. Methanol is the preferred alkanol, in large part for reasons of economy. Preferably, the concentration of lower alkanol employed in the sulfonic acid neutralization step is between about 0.5 and 1 percent by weight of the combined charge of the sulfonic acid and the volatile solvent.

The oil-soluble sulfonic acid, the overbased magnesium sulfonate, the lower alkanol and the volatile solvent may be admixed in any desired manner. Once suitably combined, the solution is heated to a temperature between about 180° F. and 260° F. or more, preferably between about 200° F. and 240° F., with agitation, to neutralize the sulfonic acid, volatilize off the lower alkanol, and to improve the stability of the final overbased magnesium sulfonate product. Any low boiling aliphatic solvent (boiling point below about 200° F.) present in the neutralization solution should also be vaporized off during this heating step, which may necessitate the use of a higher temperature or longer heating time than would otherwise be employed.

After the sulfonic acid has been neutralized, the neutralized sulfonate mixture is cooled to a temperature below about 140° F., preferably to between about 100° F. and 120° F. At this point, a non-volatile diluent oil, naphthenic acid, a lower alkanol, and magnesium oxide (preferably having certain specific characteristics) are added to the neutralized sulfonate to form a second admixture.

A wide variety of non-volatile diluent oils are suitable in the process of this invention. The principal requisites desired in the diluent oil are that it act as a solvent for the various materials employed in the process and that it has a flash point of 385°–400° F. or above. Advantageously, the diluent oil is a naphthenic lubricating oil. Preferably this naphthenic lubricating oil has a viscosity range of 100–600 SSU at 100° F.

The naphthenic acid is employed in this process as a promoter and as a stabilizing agent. If naphthenic acid is not employed, the final magnesium sulfonate product will tend to be noticeably hazy and to have an unacceptably low TBN of about 170–300 and a lighter than normal color. Advantageously, the naphthenic acid has an acid number between about 150 and 200 with non-saponifiables of about 25 to 30%. The naphthenic acid advantageously comprises from about 1 to 15 percent by weight of the final highly basic product, preferably from about 2 percent to 7 percent.

The magnesium oxide used in this process preferably has a bulk density between about 13 and 20 lbs/ft.$^3$, an Iodine No. between about 35 and 60 meq/100 g, and passes through a 200 mesh screen. Most preferably the magnesium oxide has a bulk density of 13–17 lbs/ft$^3$. The type of magnesium oxide used in this process appears to be quite important and magnesium oxides which do not have all of the above characteristics have a strong tendency to produce hazy, low TBN overbased sulfonates. For example, magnesium oxides having an Iodine Number number significantly in excess of 60 result in overbased magnesium sulfonates which generally are noticeably hazy and have TBN's of 300 or below. Of course, the amount of magnesium oxide employed in the process depends on the desired TBN of the final product and the amount of neutralized sulfonate employed. Since magnesium oxides very in their reactivity, the amount of magnesium oxide also depends on the utilization level of the specific batch being used.

Suitable lower alkanols include any of the lower alkanols noted above. Again, the preferred lower alkanol for the second admixture is methanol. Advantageously, the lower alkanol is added in an amount of from about 15 to 40% of the weight of the magnesium oxide employed in the process, preferably in an amount of from about 22 to 32% of the weight of the magnesium oxide.

The non-volatile diluent oil, the naphthenic acid and the lower alkanol may be added to the neutralized sulfonate in any order, but all should be added prior to the addition of the magnesium oxide. If this procedure is followed, the temperature of the second admixture will normally drop to about 50°–60° F. prior to the addition of the magnesium oxide. With magnesium oxide addition, the temperature of the stirred solution tends to increase and should advantageously be stabilized at between about 70° F. and 80° F. during the remainder of the magnesium oxide addition.

After all of the magnesium oxide has been added, the admixture is then carbonated, preferably with gaseous or liquid carbon dioxide. During the carbonation step, the temperature of the admixture should perferably be maintained between about 100° F. and 120° F. In large scale preparations, the preferred rate of carbon dioxide addition is about 20–22 lbs/min, and the total addition time normally is between about 1½ and 2½ hours, although the carbonation time is not a critical feature of the invention. Of course, the total amount of carbon dioxide added depends on the amount of overbasing magnesium oxide. In large scale preparations, approximately one mole of carbon dioxide should be used per reactive mole of magnesium oxide as amounts substantially in excess of one mole per mole tend to produce undesirable properties in the final product, such as haze, gel formation, etc. In small scale preparations, relatively large amounts of carbon dioxide (between about 1.0 and 1.3 moles per mole of magnesium oxide) may be employed.

Water and either ammonia or an ammonium compound, such as ammonium hydroxide, an ammonium salt, and the like, are added as promoters during the initial phase of the carbonation. Preferably, water and ammonia (added in the form of ammonium hydroxide) are used as the promoters. Substantially, all of the carbonation promoter (i.e., the water and ammonia) must be added after carbonation begins, during the addition of the first 25% of the amount of carbon dioxide added. The addition of a substantial amount of the carbonation promoters either before carbonation begins or after the initial 25% of the carbon dioxide has been added tends to produce severe processing and product quality problems. Preferably, all of the carbonation promoter is added slowly, after carbonation has begun and before the addition of the first 15% to 20% of the carbon dioxide has been completed. It should be noted that the promoter addition period truly appears to be dependent on the amount of carbon dioxide which has been added, not on the time over which the addition takes place.

The amount of water used as a promoter advantageously is about 35 to 75 percent of the weight of magnesium oxide. Preferably, the water is present in an amount of from about 44 to 60 percent of the weight of the magnesium oxide. Ammonia advantageously is added in an amount of from about 3 to 12 percent of the magnesium oxide, preferably from about 6.4 to 10.3 percent. When ammonium hydroxide is used as the source of ammonia, it advantageously is added in an amount of from about 10 to 35 percent of the magnesium oxide, preferably from about 19 to 27 percent.

After all of the carbon dioxide has been added, the carbonated solution is heated to a temperature in excess of the boiling point of the water and the lower alkanol to remove those substances from the solution, which tends to eliminate or minimize the haze in the final product. Advantageously, the carbonated solution is heated to a temperature of about 250° F. or more, preferably to a temperature between about 260° F. and 290° F.

After this heating step, the solution is cooled to a temperature between about 180° F. and 220° F., preferably between about 190° F. and 200° F., at which temperature additional carbon dioxide is added. This second carbon dioxide addition is advantageously made at a rate equivalent to the initial charge, for from about 10 to 30 minutes. Preferably this second carbon dioxide charge lasts about 15 minutes at the same rate of addition as the initial carbon dioxide charge. This step is used to help stabilize the sediment for easier removal during clarification.

After the second carbon dioxide addition, the solution is again heated to an elevated temperature to remove water. As before, the ultimate temperature attained during this heating step is about 250° F. or more, preferably between about 260° F. and 290° F.

The solution is next cooled to a temperature between about 100° F. and 220° F., preferably about 200° F. Additional volatile solvent is then added to form a solution having between about 60% and 80% solvent and diluent oil. Preferably this additional volatile solvent is a mixture of aromatic hydrocarbons having a boiling point range between about 250° F. and 300° F., most preferably between about 270° F. and 285° F.

After dilution, the solution is clarified, preferably by centrifugation and/or filtration, to remove suspended solids and sediment. The clarified solution is then advantageously heated to a temperature in excess of 300° F., preferably in excess of about 355° F., under vacuum, to remove the volatile solvents. Additional diluent oil and the like may be added, as needed, to meet specific customer specifications.

A typical highly basic magnesium sulfonate made in accordance with the preferred embodiments of this invention has the following general characteristics:

| | |
|---|---|
| TBN, mg KOH/g | 385 Min.-500 |
| Magnesium, wt. % | 9–10.5 (preferably 9.2–9.7) |
| Sulfonate, wt. % | 25–35 (preferably 27–30) |
| Sulfur, wt. % | 1.8–2.2 |
| Viscosity, SSU at 210° F. | 700–1000 |
| Density, lbs/gal | 9.2–9.5 |
| Flash, °F. | 370 Min. |
| Color, D-1500 | 5.5 Max. |
| BS & W, wt. % | 0.05 Max. |

-continued

| | |
|---|---|
| Water, wt. % | 0.6 Max. |
| Odor | Bland |
| Appearance | Bright & Clear |

Fluid, highly basic magnesium sulfonates made in accordance with the invention have been tested under in use conditions and have been found to have satisfactory stability and compatability for commercial use.

EXAMPLE 1

To a one liter flask were added: 111 g of sulfonic acid A*; 185 g of sulfonic acid B*; 30 g of a previously overbased magnesium sulfonate having a TBN of 327; about 2 g of methanol; and 250 g of an aromatic solvent having a distillation range of 280°–290° F. Sulfonic acid A was prepared by sulfonating a straight chain alkylate having a molecular weight of about 550 under standard conditions in an aliphatic solvent having a distillation range of about 140°–190° F. Sulfonic acid B was prepared by sulfonating a branched chain alkylate having a molecular weight of about 425 under standard conditions in an aliphatic solvent having a distillation range of about 140°–190° F. This admixture was stirred and heated to about 220° F. to neutralize the sulfonic acids and to remove the aliphatic solvent and the methanol. After heating, the solution was cooled to 100°–120° F. and the following were added: 5 g of a naphthenic lubricating oil having a viscosity of about 200 SSU at 100° F.; 7 g of a naphthenic acid having an acid number of 155 and non-saponafiables of about 25–30%; and 10 g of methanol. 36 g of magnesium oxide were then added. This magnesium oxide had a bulk density of 15 lbs/ft$^3$, an Iodine No. of 35 meq/100 g and a screen size of 200 mesh.

*The weights given for sulfonic acids A and B include the sulfonation solvent which comprises about 68–75% of the indicated weight.

Carbonation with gaseous carbon dioxide was then begun at a temperature between 100° F. and 120° F. and a rate of about 0.5–1.5 g/min. A promoter solution consisting of 8 g of ammonium hydroxide (27–30% ammonia) and 20 g of water was added uniformly from the beginning of the carbonation, at a rate sufficient to complete the promoter addition by the time 20% of the necessary carbon dioxide had been added. After completion of the promoter addition, the carbon dioxide addition was allowed to continue for a total of about 2 hours, until the required amount of carbon dioxide had been added. Following carbonation, the solution was heated to 275° F. and then cooled to 190°–200° F. Additional $CO_2$ was added, for 15 minutes, at the same rate as that of the initial $CO_2$ addition. The solution was next heated to 260° F., and then cooled to 200° F. and diluted with additional volatile solvent. Next, the diluted solution was clarified by centrifugation and the volatile solvents were then removed by heating to 400° F. After cooling, the product was found to have a TBN (mg KOH/g) of 430 and a viscosity of 1000 SSU at 210° F. The product contained 31.45% by weight magnesium sulfonate (at an equivalent weight 612) and the product had a bright appearance, good color, and was free of haze and sediment.

EXAMPLE 2

An admixture was prepared from 296 parts (by weight) of a sulfonic acid (including solvent), 30 parts of a previously overbased magnesium sulfonate and about 2 parts methanol. The sulfonic acid had a molecular weight of 612 and was prepared from a mixture of straight and branched chain alkylates. The magnesium sulfonate again had a TBN of 327. This admixture was stirred and then heated to about 220° F. to neutralize the sulfonic acid. After cooling to 100°–120° F., the following were added: 5 parts of a naphthenic lubricating oil, 7 parts of a naphthenic acid, 10 parts of methanol and 36 parts of a magnesium oxide having the characteristics listed in Example 1. Carbonation was then begun and a promoter solution of 8.2 parts ammonium hydroxide and 20 parts water was added at a uniform rate concurrently with the addition of the first 20% of the carbon dioxide gas. Following carbonation, the solution was heated to 275° F. and then cooled to 190°–200° F. Additional $CO_2$ was added for about 15 minutes at the same rate as that of the initial $CO_2$ addition. The solution was then heated to about 260° F. and thereafter cooled to about 200° F. and diluted with additional volatile solvent. After dilution, the solution was clarified and the volatile solvents were then removed by heating to about 400° F. The final magnesium sulfonate product had a TBN of 430 and a viscosity of 1000 SSU at 210° F. The product contained 31.45% by weight magnesium sulfonate and 10.43% by weight magnesium. It had a color of 5.0 according to D-1500 and was bright and clear in appearance.

EXAMPLE 3

A highly basic magnesium sulfonate was prepared from the following components in accordance with the procedure of Example 1:

| Material | Parts by Weight |
|---|---|
| Sulfonic acid (M.W. 524) | 152 |
| Magnesium sulfonate (TBN 327) | 30 |
| Diluent oil | 28 |
| Naphthenic acid | 10 |
| Magnesium oxide | 36 |
| Methanol | 13 |
| Ammonium hydroxide | 10 |
| Water | 20 |

The final product had a TBN of 413 and a viscosity of 800 SSU at 210° F., and it contained 10.16% magnesium and 31.90% magnesium sulfonate. It had a color of 4.5 and was bright and clear.

EXAMPLE 4

Another highly basic magnesium sulfonate was prepared from the following components in accordance with the general procedure described in Example 1:

| Material | Parts by Weight |
|---|---|
| Sulfonic acid (612 M.W.) | 1386 |
| Magnesium sulfonate (TBN 287) | 220 |
| Diluent oil | 443 |
| Naphthenic acid | 95 |
| Magnesium oxide | 316 |
| Methanol | 110 |
| Ammonium hydroxide | 89 |
| Water | 222 |

Aromatic solvent having a distillation range of 260°–285° F. was used as a diluting solvent prior to clarification. The final product had a TBN of 423 and contained 34.2% magnesium sulfonate and 10.28% magnesium. It had a viscosity of 1200 SSU at 210° F., a color of 5.5 and was bright and clear.

EXAMPLE 5

The following materials were used in a 5 liter preparation in accordance with the general procedure described in Example 1:

| Material | Parts by Weight |
|---|---|
| Sulfonic acid (612 M.W.) | 1480 |
| Magnesium sulfonate (TBN 327) | 150 |
| Diluent oil | 25 |
| Naphthenic acid | 35 |
| Magnesium oxide | 180 |
| Methanol | 50 |
| Ammonium hydroxide | 41.4 |
| Water | 100.8 |

The final product obtained from these materials had a TBN of 426, a viscosity of 1186 SSU at 210° F., and it contained 10.31% magnesium and 32.98% magnesium sulfonate. It also was bright and clear and had a color of 4.5.

EXAMPLE 6

The following materials were used in a 12 liter preparation:

| Materials | Parts by Weight |
|---|---|
| Sulfonic acid | 3552 |
| Magnesium sulfonate | 360 |
| Diluent oil | 60 |
| Naphthenic acid | 84 |
| Magnesium oxide | 432 |
| Methanol | 120 |
| Ammonium hydroxide | 138 |
| Water | 240 |

These materials were utilized in accordance with the general procedure of Example 1. The final product had a TBN of 412, and it contained 33.28% magnesium sulfonate and 10.01% magnesium. It had a color of 5.0 and was bright and clear in appearance.

EXAMPLE 7

The charge and conditions employed in Example 1 were followed except that the aromatic solvent was omitted. The alkylate was sulfonated with an aliphatic solvent having a distillation range of 260°–285° F. and additional aliphatic solvent of the same range was added to give the same charge as in Example 1. The product was bright in appearance, fluid and had a TBN of about 420.

EXAMPLE 8

Example 1 was repeated using a naphthenic acid having an acid number of 195 and saponifiables of about 25–30%. The product had essentially the same characteristics as the product of Example 1.

EXAMPLES 9–13

In these Examples the charge of Example 1 was modified as indicated, while the process conditions remained essentially unchanged.

9

The ammonium hydroxide was doubled to 16 g. Thickening occurred in the stripping procedure and the solution gelled.

10

The water was increased to 30 g. The final product had a noticeable haze and a TBN of only about 250–272.

11

The naphthenic acid was omitted. The product was much lighter in appearance and had noticeable haze. The TBN was about 270–300.

12

A different magnesium oxide was employed. It had a bulk density of about 15, an Iodine No. of 30 and passed a 200 mesh screen. The product had a TBN between 200 and 300 and was noticeably hazy.

13

Thirty-six grams of a magnesium oxide having an Iodine No. of 65, a bulk density of 20, and a particle size less than 200 mesh were employed along with the following components:

| Materials | Parts by Weight |
|---|---|
| Sulfonic acid | 296 |
| Magnesium sulfonate | 30 |
| Diluent oil | 5 |
| Naphthenic acid | 7 |
| Methanol | 10 |
| Ammonium hydroxide | 8.2 |
| Water | 20 |

The final product had a TBN of 275 and was slightly hazy.

EXAMPLES 14–18

In these Examples the charge of Example 1 was employed but the process conditions were altered as indicated.

14

The neutralization heating step was omitted. The product lacked stability in solubility tests and had a high sediment level. The TBN was between 250 and 300.

15

The ammonium hydroxide and water were added before the start of the carbonation. The solution thickened during carbonation with a tendency toward gel formation. If a product can be recovered, it typically has a TBN between 180 and 250 and is very hazy.

16

The ammonium hydroxide and water were added slowly to extend their addition period beyond the initial 25% of the carbonation. Thickening occurred during carbonation and subsequent heating resulted in gel formation. The product was very difficult to recover and was typified by a viscosity of 20–30,000 SSU at 210° F.

17

The carbonation temperature was kept to between 80° F. and 100° F. The solution did not darken during carbonation. Appearance was hazy and the TBN was between 200 and 300. Sediment was high and filtration poor.

The carbonation temperature was permitted to range between 80° and 140° F. The product had a slight haze. A hard to remove hazy sediment also has occurred under such temperature conditions.

Repeated attempts to utilize the preferred embodiments of the process for calcium overbasing have been unsuccessful.

Percentages used herein and in the following claims are weight percentages unless otherwise stated.

While particular embodiments of the invention have been described, it will be understood that the invention is not limited thereto, but includes such modifications and variations as come within the scope and spirit of the claims.

We claim:

1. A process for preparing a fluid, highly basic magnesium sulfonate comprising:
(a) forming, in the presence of a volatile solvent, an admixture of an oil-soluble sulfonic acid and a magnesium sulfonate having a TBN in excess of about 200;
(b) neutralizing the sulfonic acid;
(c) forming a second admixture of: (i) the sulfonate prepared from the first admixture, (ii) magnesium oxide, (iii) a naphthenic acid, and (iv) a lower alkanol;
(d) treating the second admixture with carbon dioxide;
(e) treating the second admixture with (i) water and (ii) ammonia or an ammonium compound during the initial phase of the carbon dioxide treatment;
(f) heating the carbonated solution to remove water and the lower alkanol;
(g) cooling and thereafter treating the water and lower alkanol depleted solution with additional carbon dioxide;
(h) heating the further carbon dioxide treated solution to remove water; and
(i) thereafter clarifying the solution.

2. The process of claim 1, further comprising the addition of a lower alkanol to the first admixture and the addition of a diluent oil prior to clarification.

3. The process of claim 1, wherein the magnesium oxide has a bulk density between about 13 and 20 lbs/ft$^3$ and an Iodine No. between about 35 and 60 meq/100 g.

4. The process of claim 1, wherein substantially all of the water and the ammonia or ammonium compound is added to the second admixture during the addition of the first 25% of the amount of carbon dioxide added during step (d).

5. The process of claim 1, wherein the sulfonic acid is neutralized by heating the first admixture to a temperature in excess of about 180° F.

6. A process for preparing a fluid, highly basic magnesium sulfonate comprising:
(a) forming, in the presence of a volatile solvent, an admixture of: (i) an oil-soluble sulfonic acid, (ii) a magnesium sulfonate having a TBN in excess of about 200, and a lower alkanol;
(b) heating the admixture to neutralize the sulfonic acid;
(c) cooling the admixture and thereafter forming a second admixture of: (i) the sulfonate prepared from the first admixture, (ii) magnesium oxide, (iii) a naphthenic acid, and (iv) a lower alkanol;
(d) treating the second admixture with carbon dioxide;
(e) treating the second admixture with (i) water and (ii) ammonia or an ammonium compound during the initial phase of the carbon dioxide treatment;
(f) heating the carbonated solution to remove water and the lower alkanol;
(g) cooling and thereafter treating the water and lower alkanol depleted solution with additional carbon dioxide;
(h) heating the further carbon dioxide treated solution to remove water; and
(i) thereafter clarifying the solution.

7. The process of claim 6, wherein the sulfonic acid comprises at least one synthetic sulfonic acid having a molecular weight ranging between about 450 and 650.

8. The process of claim 6 wherein the lower alkanol is methanol.

9. The process of claim 6, wherein the magnesium oxide has a bulk density between about 13 and 20 lbs/ft$^3$ and an Iodine No. between about 35 and 60 meq/100 g.

10. The process of claim 6, wherein substantially all of the water and the ammonia or ammonium compound is added to the second admixture during the addition of the first 25% of the carbon dioxide added during step (d).

11. The process of claim 6, wherein the naphthenic acid has an acid number between about 150 and 200.

12. The process of claim 6, wherein (i) the sulfonic acid is a synthetic sulfonic having a molecular weight of between 450 and 650, (ii) the lower alkanol is methanol, (iii) the magnesium oxide has a bulk density between about 13 and 20 lbs/ft$^3$ and an Iodine No. between about 35 and 60 meq/100 g, (iv) substantially all of the water and the ammonia is added to the second mixture during the addition of the first 25% of the carbon dioxide added during step (d), (v) the naphthenic acid has an acid number between about 150 and 200, (vi) the additional carbon dioxide treatment of step (g) occurs for a time between about 10 and 30 minutes, (vii) and a diluent oil is added prior to clarification.

13. The process of claim 6, wherein (i) the sulfonic acid is neutralized at a temperature between about 200° F. and 240° F., (ii) the second admixture is formed at a temperature below about 120° F., (iii) at least about one mole of carbon dioxide is added in step (d) per reactive mole of magnesium oxide at a temperature between about 100° F. and 120° F., (iv) the carbonated solution is heated to a temperature in excess of about 250° F., (v) the additional carbon dioxide added in step (g) is added at a temperature of between about 180° F. and 220° F., (vi) the further carbon dioxide treated solution is heated to a temperature in excess of about 250° F, (vii) volatile solvent is added prior to clarification, and (viii) at least a substantial amount of the volatile solvent is removed after clarification.

14. The process of claim 12, wherein (i) the sulfonic acid is neutralized at a temperature between about 200° F. and 240° F., (ii) the second admixture is formed at a temperature below about 120° F., (iii) at least about one mole of carbon dioxide is added in step (d) per reactive mole of magnesium oxide at a temperature between about 100° F. and 120° F., (iv) the carbonated solution is heated to a temperature in excess of about 250° F., (v) the additional carbon dioxide added in step (g) is added at a temperature of between about 180° F. and 220° F., (vi) the further carbon dioxide treated solution is heated to a temperature in excess of about 250° F., (vii) volatile solvent is added prior to clarification, and (viii) at least a substantial amount of the volatile solvent is removed after clarification.

15. A process for preparing a fluid, highly basic magnesium sulfonate comprising:

(a) forming, in the presence of a suitable solvent, an admixture of an oil-soluble sulfonic acid, a magnesium sulfonate having a TBN in excess of about 200, and a lower alkanol;

(b) heating the admixture to neutralize the sulfonic acid;

(c) cooling the admixture to a temperature below about 120° F. and thereafter forming a second admixture of: the sulfonate prepared from the first admixture, a magnesium oxide having a bulk density between about 13 and 20 lbs/ft$^3$, an Iodine No. between about 35 and 60 meq/100 g and a particle size less than about 200 mesh, and a lower alkanol.

(d) treating the second admixture with at least about one mole of carbon dioxide per reactive mole of magnesium oxide at a temperature between about 100° F. and 120° F.;

(e) treating the second admixture with (i) water and (ii) ammonia or an ammonium compound, substantially all of the water and the ammonia or ammonium compound being added after carbon dioxide treatment has begun, during the addition of about the initial 25% of the carbon dioxide;

(f) heating the carbonated solution to a temperature in excess of about 250° F. to remove water and the lower alkanol;

(g) treating the water and lower alkanol depleted solution with additional carbon dioxide for about 10 to 30 minutes at a temperature between about 180° and 220° F.;

(h) heating the further carbon dioxide treated solution to a temperature in excess of about 250° F. to remove water; and (i) thereafter clarifying the treated solution and removing at least a substantial amount of the volatile solvent.

16. The process of claim 15, wherein a diluent oil is added prior to clarification.

17. The process of claim 16, wherein (i) the lower alkanol is methanol, (ii) the methanol is present in the first admixture in an amount of from 0.5 to 1.0 percent by weight of the sulfonic acid and solvent, (iii) the first admixture is heated to a temperature in excess of about 200° F., (iv) the methanol is present in the second admixture in an amount of from about 15 to 40 percent by weight of the magnesium oxide, (v) the water is added in an amount of from about 35 to 75 percent by weight of the magnesium oxide, and (vi) ammonia is added during carbonation in an amount of from about 3 to 12 percent by weight of the magnesium oxide.

18. The process of claim 17, wherein the methanol is present in the second admixture in an amount of from about 22 to 32 percent, the water is added in an amount of from about 44 to 60 percent and the ammonia is added in an amount of from about 6.4 to 10.3 percent.

19. A process for preparing a fluid, highly basic magnesium sulfonate comprising:

(a) forming an admixture of: (i) an oil-soluble sulfonic acid, (ii) a magnesium sulfonate, having a TBN in excess of about 200, in an amount sufficient to neutralize the sulfonic acid, (iii) a volatile solvent, and (iv) a lower alkanol present in an amount of from about 0.25 to 2 percent by weight of the sulfonic acid and solvent;

(b) heating the admixture to a temperature in excess of about 180° F. to neutralize the sulfonic acid;

(c) forming a second admixture, at a temperature below about 120° F., of: (i) the neutralized sulfonic acid, (ii) a magnesium oxide having a bulk density between about 13 to 20 lbs/ft$^3$, an Iodine No. between about 35 and 60 meq/100 g and a particle size smaller than about 200 mesh, (iii) a naphthenic acid having an acid number between about 150 to 200 in an amount of from about 1 to 15 percent of the weight of the final product; and (iv) a lower alkanol present in an amount of from about 15 to 40 percent by weight of the magnesium oxide;

(d) treating the second admixture with at least about one mole of carbon dioxide per reactive mole of magnesium oxide at a temperature between about 100° F. and 120° F.:

(e) treating the admixture with water and ammonia, substantially all of the water and ammonia being added after the carbon dioxide treatment has begun, during the addition of about the initial 25% of the carbon dioxide, the water being added in an amount of from about 35 to 75 percent by weight of the magnesium oxide, the ammonia being added in an amount of from about 3 to 12 percent by weight of the magnesium (f) heating the carbonated solution to a temperature in excess of about 250° F. to remove water and the lower alkanol;

(g) treating the water and lower alkanol depleted solution with additional carbon dioxide for about 10 to 30 minutes at a temperature between about 180° F. and 220° F.

(h) heating the further carbon dioxide treated solution to a temperature in excess of about 250° F. to remove water; and (i) thereafter adding a volatile solvent to the solution, clarifying the solution, and removing at least a substantial amount of the volatile solvent from the clarified solution;

wherein a non-volatile diluent oil is added prior to clarification.

20. The process of claim 19, wherein the sulfonic acid is a synthetic sulfonic acid having a molecular weight between about 450 and 650.

21. The process of claim 19, wherein the sulfonic acid is a synthetic sulfonic acid having a molecular weight between about 500 and 575.

22. The process of claim 20 wherein the sulfonic acid is a mixture of sulfonated straight and branched chain alkylates, the straight chain alkylate having a molecular weight between about 500 to 600 and the branched chain alkylate having a molecular weight between about 385 and 450.

23. The process of claim 19, wherein the magnesium sulfonate used to form the first admixture has a TBN between about 250 to 350 and sufficient magnesium sulfonate is used to prepare a neutralized sulfonic acid solution having a base number between about 5 and 20.

24. The process of claim 19, wherein the lower alkanol is methanol, the methanol is present in the first admixture in an amount of from about 0.5 to 1 percent and in the second admixture in an amount of from about 22 to 32 percent of the magnesium oxide.

25. The process of claim 19, wherein the amount of naphthenic acid present is from about 2 to 7 percent of the weight of the final product.

26. The process of claim 19, wherein the diluent oil is added to the second admixture.

27. The process of claim 19, wherein the second admixture is treated with about one mole of carbon dioxide.

28. The process of claim 19, wherein the water is added in an amount of from 44 to 60 percent of the weight of the magnesium oxide.

29. The process of claim 19, wherein the ammonia is added in an amount of from 6.4 to 10.3 percent of the weight of the magnesium oxide.

30. The process of claim 19, wherein (i) the first admixture is heated to a temperature between about 200° F. and 240° F., (ii) the carbonated solution is heated to a temperature between about 260° F. and 290° F., and (iii) the further carbon dioxide treated solution is heated to a temperature between about 260° F. and 290° F.

31. The process of claim 30, wherein the water and lower alkanol depleted solution is treated with carbon dioxide at a temperature between about 190° F. and 200° F.

32. The process of claim 30, wherein (i) the lower alkanol is methanol, (ii) the methanol is present in the first admixture in an amount of from about 0.5 to 1 percent and in the second admixture in an amount of from about 22 to 32 percent of the magnesium oxide, (iii) the water is added in an amount of from about 44 to 60 percent of the weight of the magnesium oxide, and (iv) the ammonia is added in an amount of from about 6.4 to 10.3 percent of the weight of the magnesium oxide.

33. The process of claim 32, wherein the sulfonic acid is a synthetic sulfonic acid having a molecular weight between about 450 and 650.

34. The process of claim 33 wherein the sulfonic acid is a mixture of sulfonated straight and branched chain alkylates, the straight chain alkylate having a molecular weight between about 500 to 600 and the branched chain alkylate having a molecular weight between about 385 and 450.

35. A fluid, highly basic magnesium sulfonate produced according to the process of claim 1.

36. A fluid, highly basic magnesium sulfonate produced according to the process of claim 6.

37. A fluid, highly basic magnesium sulfonate produced according to the process of claim 13.

38. A fluid, highly basic magnesium sulfonate produced according to the process of claim 14.

39. A fluid, highly basic magnesium sulfonate produced according to the process of claim 15.

40. A fluid, highly basic magnesium sulfonate produced according to the process of claim 19.

41. A fluid, highly basic magnesium sulfonate produced according to the process of claim 20.

42. A fluid, highly basic magnesium sulfonate produced according to the process of claim 32.

43. A fluid, highly basic magnesium sulfonate produced according to the process of claim 34.

* * * * *

UNITED STATES PATENT AND TRADEMARK OFFICE

CERTIFICATE OF CORRECTION

PATENT NO. : 4,225,446

DATED : September 30, 1980

INVENTOR(S) : Jerry D. Arnold, et al.

It is certified that error appears in the above-identified patent and that said Letters Patent are hereby corrected as shown below:

Column 4, line 1, "aout" should read --about--.
line 53, "170" should read --270--.

Column 5, line 8, "very" should read --vary--.
line 33, "perferably" should read --preferably--.

Claim 15, line 15, the "." at end of line should be --;--.

Claim 19, line 15, "to" should read --and--.
line 18, "to" should read --and--.
line 26, the ":" should be --;--.
line 35, --oxide;-- should appear after "magnesium"
line 42, a --;-- should appear after "220°F."

Claim 23, line 3, "to" should read --and--.

Signed and Sealed this

*Seventeenth* Day of *March 1981*

[SEAL]

*Attest:*

RENE D. TEGTMEYER

*Attesting Officer*

*Acting Commissioner of Patents and Trademarks*